US008936501B2

(12) United States Patent
Bell

(10) Patent No.: US 8,936,501 B2
(45) Date of Patent: Jan. 20, 2015

(54) TOY FIGURE WITH ILLUMINATED PORTION

(75) Inventor: Joseph Bell, Lakewood, CA (US)

(73) Assignee: Mattel, Inc., El Segundo, CA (US)

( * ) Notice: Subject to any disclaimer, the term of this patent is extended or adjusted under 35 U.S.C. 154(b) by 141 days.

(21) Appl. No.: 13/593,094

(22) Filed: Aug. 23, 2012

(65) Prior Publication Data

US 2013/0090036 A1 Apr. 11, 2013

Related U.S. Application Data

(60) Provisional application No. 61/528,487, filed on Aug. 29, 2011.

(51) Int. Cl.

| | |
|---|---|
| ***A63H 3/00*** | (2006.01) |
| ***A63H 33/26*** | (2006.01) |
| ***F21V 7/00*** | (2006.01) |
| ***A63H 33/22*** | (2006.01) |

(52) U.S. Cl.

CPC ..... *A63H 3/006* (2013.01); *A63H 33/26* (2013.01); *F21V 7/00* (2013.01); *A63H 33/22* (2013.01)

USPC ..... 446/219

(58) Field of Classification Search

CPC ..... A63H 1/00; A63H 3/00; A63H 3/006

USPC ..... 446/219

See application file for complete search history.

(56) References Cited

U.S. PATENT DOCUMENTS

| | | | | |
|---|---|---|---|---|
| 740,817 | A | 10/1903 | Davis | |
| 876,739 | A | 1/1908 | Siever et al. | |
| 2,933,853 | A * | 4/1960 | Laval, Jr. | 446/219 |
| 3,122,859 | A * | 3/1964 | La Reaux, Jr. | 446/152 |
| 3,440,349 | A | 4/1969 | Gibbs | |
| 3,594,949 | A | 7/1971 | Tam | |
| 3,654,710 | A | 4/1972 | Barnard | |
| 3,740,039 | A | 6/1973 | Prola | |
| 4,209,941 | A | 7/1980 | Bourque | |
| 4,752,273 | A * | 6/1988 | Woods | 446/392 |
| 4,802,879 | A * | 2/1989 | Rissman et al. | 446/175 |
| 4,878,873 | A * | 11/1989 | Yamaguchi et al. | 446/321 |
| 5,041,044 | A | 8/1991 | Weinreich | |
| 5,084,803 | A | 1/1992 | Lan | |
| 5,277,644 | A | 1/1994 | Osborne et al. | |
| 5,288,259 | A * | 2/1994 | Konta et al. | 446/219 |
| 5,439,407 | A | 8/1995 | Friedel | |
| 5,545,072 | A | 8/1996 | Arad et al. | |

(Continued)

FOREIGN PATENT DOCUMENTS

| | | |
|---|---|---|
| GB | 2026331 A | 2/1980 |
| GB | 2199256 A | 7/1988 |

(Continued)

*Primary Examiner* — Kurt Fernstrom

*Assistant Examiner* — Dolores Collins

(74) *Attorney, Agent, or Firm* — Edell, Shapiro & Finnan, LLC

(57) ABSTRACT

A toy figure is disclosed. The toy figure includes a portion that is configured to be illuminated by a light source. The portion includes a panel member that is transparent or translucent. The panel member has a light input surface and a light output surface. The panel member also includes a reflecting surface that redirects light in the panel member. Light from the light source enters the light input surface and exits from the light output surface. In one embodiment, the light output surface includes several deformities.

14 Claims, 9 Drawing Sheets

(56) References Cited

U.S. PATENT DOCUMENTS

| | | | | |
|---|---|---|---|---|
| RE35,556 | E | 7/1997 | Weinreich | |
| 5,672,090 | A * | 9/1997 | Liu | 446/268 |
| 5,733,167 | A | 3/1998 | Kroigaard | |
| 5,947,789 | A | 9/1999 | Chan | |
| 6,036,576 | A | 3/2000 | Colon, Jr. | |
| 6,080,034 | A | 6/2000 | Bennett Harris | |
| 6,322,421 | B1 | 11/2001 | Hou | |
| 6,371,827 | B1 | 4/2002 | Chou | |
| 6,450,855 | B1 | 9/2002 | Tang | |
| 6,575,810 | B1 * | 6/2003 | Sohn | 446/485 |
| 6,699,094 | B1 * | 3/2004 | Ward | 446/175 |
| 6,948,999 | B2 | 9/2005 | Chan | |
| 6,955,581 | B1 | 10/2005 | Liu | |
| 7,503,670 | B1 * | 3/2009 | Mengle | 362/202 |
| 2012/0088434 | A1 * | 4/2012 | Teel et al. | 446/268 |

FOREIGN PATENT DOCUMENTS

| | | | |
|---|---|---|---|
| GB | 2277881 | A | 11/1994 |
| WO | 93/23128 | A1 | 11/1993 |

* cited by examiner

TOY FIGURE WITH ILLUMINATED PORTION

CROSS-REFERENCE TO RELATED APPLICATION

This application claims priority to and is based on U.S. patent application Ser. No. 61/528,487, filed Aug. 29, 2011, entitled "Toy Figure with Illuminated Portion," the entire disclosure of which is incorporated by reference herein in its entirety.

FIELD OF THE INVENTION

The present invention relates to a toy figure, and in particular, to a toy figure that has one or more portions that are illuminated by a light source.

BACKGROUND OF THE INVENTION

Conventional toy figures, such as action figures and dolls, are used by children. Many toy figures lack any creative or unique features, that otherwise can enhance the play with the toy figures.

There is a need for a toy figure that has a creative play feature, and in particular, there is a need for a toy figure with a visually creative play feature.

SUMMARY OF THE INVENTION

The present invention is directed to a toy figure. The toy figure includes a portion that is configured to be illuminated by a light source. The portion includes a panel member that is transparent or translucent. The panel member has a light input surface and a light output surface. The panel member also includes a reflecting surface that redirects light in the panel member. Light from the light source enters the light input surface and exits from the light output surface. In one embodiment, the light output surface includes several deformities.

In one embodiment, a toy comprises a first housing having an electronic system including a light source; and a second housing coupled to the first housing, the second housing includes a panel member having a light input surface and a light output surface, the light input surface receives light from the light source, the light source is spaced apart from the panel member, and light is emitted from the panel member of the second housing.

In an alternative embodiment, the second housing is movably coupled to the first housing.

In an alternative embodiment, the second housing is removable from the first housing.

In an alternative embodiment, the light output surface includes at least one deformity.

In an alternative embodiment, the second housing includes a panel member, the panel member is translucent or transparent, and the light output surface is located on the panel member.

In another embodiment, a toy comprises a first housing having an electronic system including a light source; and a second housing coupled to the first housing, the second portion has a light input surface and a light output surface, the light input surface is substantially parallel to the light output surface, the light input surface receives light from the light source, the light source is spaced apart from the second housing, and light is emitted from the light output surface of the second housing.

In another embodiment, a toy comprises a body portion including a light source; and an appendage coupled to the body portion, the appendage includes a light emitting member that receives light from the light source via a light input surface, and the light emitting member includes a light output surface configured to emit light from the appendage.

In an alternative embodiment, the light input surface and the light output surface are substantially parallel.

In an alternative embodiment, the light emitting member includes an emitting portion and a reflective surface, the reflective surface is proximate to the light input surface and oriented to direct light received by the light input surface toward the emitting portion, and the light output surface is located on the emitting portion.

In another embodiment, a light emitting member comprises: a body having: a first major surface defining a light output surface, the first major surface extending along a first plane; a second major surface opposite to the first major surface, the second major surface being substantially parallel to the first major surface, the second major surface extending along a second plane, the second major surface being larger than the first major surface, the difference between the second major surface and the first major surface defining a light input surface; and a reflective surface located proximate to the light input surface, the reflective surface being located between the first plane and the second plane.

In an alternative embodiment, the light input surface and the reflective surface are offset from the light output surface.

BRIEF DESCRIPTION OF THE DRAWINGS

Like reference numerals have been used to identify like elements throughout this disclosure.

DETAILED DESCRIPTION OF THE INVENTION

A toy figure according to the present invention includes a portion that is illuminated by a light source. In one embodiment, the light source is an LED. In other embodiments, the light source is a lamp, a bulb, or other lighting element. In one embodiment, the portion of the toy figure that is illuminated is an accessory or part of an accessory that is coupled to the toy figure. In another embodiment, the portion of the toy figure that is illuminated is part of the toy figure, such as a limb or a part of the body of the toy figure.

The terms "panel member" and "light emitting member" are used interchangeably herein to refer to a member or structure that receives light from a light source and from which light is emitted. According to the present invention, a panel member may have varying shapes and thicknesses in different embodiments.

Figure 1:
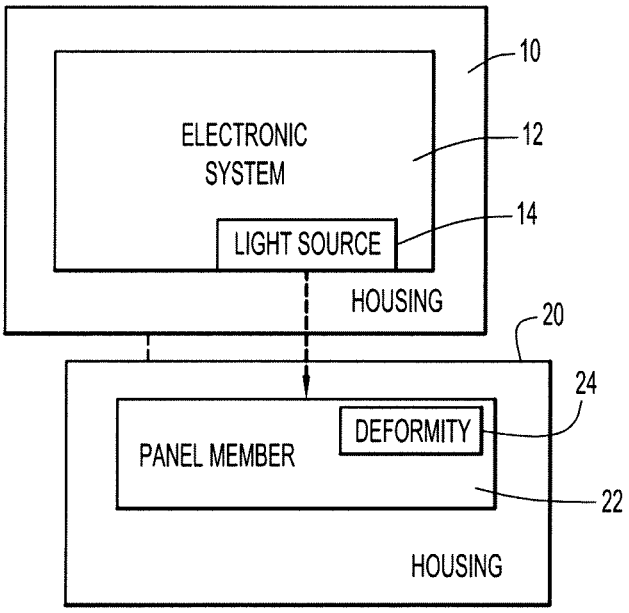
FIG. 1 illustrates a schematic block diagram of an embodiment of housings according to the present invention.

Referring to FIG. 1, a schematic block diagram according to the present invention is illustrated. A housing 10 with an electronic system 12 including a light source 14 is illustrated. The light source 14 is an LED and the illumination of the light source 14 is controlled by the electronic system 12. The light source 14 is illuminated in response to user activation of a switch and/or the electronic system 12 receiving an input from a sensor in the housing 10, such as a motion sensor, an acoustic sensor, a photosensor, or other sensor that detects an input. While a single light source 14 is illustrated in FIG. 1, the electronic system 12 may include more than one light source 14 and the multiple light sources 14 may be the same color or different colors. In addition, in alternative embodiments, a light source other than an LED is used in the housing 10.

Also illustrated in FIG. 1 is another housing 20. This housing 20 includes a panel member 22 that is made of a transparent or translucent material, such as plastic. The panel member 22 receives light from the light source 14 and permits the received light to exit the panel member 22. As light is emitted from the panel member 22, the panel member 22 is referred to alternatively as a light emitting portion or light emitting member.

In one embodiment, the panel member 22 has a deformity 24 formed therein. While only one deformity 24 is shown in FIG. 1, the panel member 22 may have multiple deformities 24.

In one embodiment, any deformities 24 in the panel member 22 are formed as etchings in the panel member 22. The etchings are either grooves or discrete, small recesses formed in the panel member 22. Alternatively, the deformities 24 may extend outwardly from the panel member 22, such as ridges, beyond an outer perimeter of the body of the panel member 22. In one embodiment, the extending deformities 24 can be integrally molded with the panel member 22. In another embodiment, the extending deformities 24 can be formed separately and coupled to the panel member 22 using a coupling technique, such as melting or an adhesive. In one embodiment, the panel member 22 may include some deformities 24 that are formed in the panel member 22 and some deformities 24 that extend outwardly from the panel member 22.

The deformities 24 form surfaces that cause the light that is reflected and traveling within the panel member 22 to exit the panel member 22 in desired locations. The quantity of deformities 24 on the panel member 22 can vary in different embodiments.

Housing 20 is placed proximate to housing 10. In one embodiment, housing 20 is coupled or mounted to housing 10 and is in contact therewith. As a result, light source 14 is proximate to the panel member 22 and light from the light source 14 can enter into a light input surface 32 (see FIG. 2) of the panel member 22. In one implementation, housing 20 is fixedly coupled to housing 10. In another implementation, housing 20 is removably coupled to housing 10 and can be snapped off or decoupled or otherwise detached from housing 10 by a child or other user. Thus, light from the light source 14 in one housing 10 is directed toward and enters a panel member 22 that is part of another housing 20 separate from housing 10. In the implementation in which housing 20 is removable from housing 10, the light source 14 in housing 10 is separated from the panel member or light emitting member 22.

In an alternative embodiment, housing 20 is spaced apart from housing 10, but located relatively near housing 10. The distance or spacing between the housings 10 and 20 is illustrated in FIG. 1. Despite the spacing between the housings 10 and 20, in such an embodiment, light from the light source 14 may enter the panel member 22 and exit therefrom via the deformities 24.

In another embodiment, housing 20 is movably coupled to housing 10. In other words, the relative connection between the housings 10 and 20 enables housing 20 to be repositioned relative to housing 10, such as by sliding, rotating, or pivoting. When housing 20 is pivotally coupled to housing 10, the panel member 22 can be moved relative to the light source 14, but light from the light source 14 can still be directed into the panel member 22 regardless of panel member 22's orientation.

Figure 2:
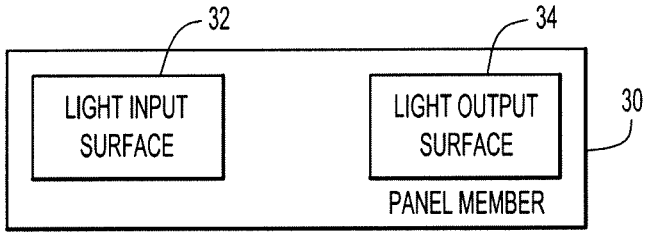
FIG. 2 illustrates a schematic block diagram of an embodiment of a panel member according to the present invention.

Referring to FIG. 2, an embodiment of a panel member according to the present invention is illustrated. In this embodiment, the panel member 30 has a light input surface 32 and a light output surface 34. The light input surface 32 is spaced apart from the light output surface 34. In one embodiment, the light input surface 32 is located on a side of the panel member 30 that is opposite to the side on which the light output surface 34 is formed. In addition, the light input surface 32 is offset from the light output surface 34, such that when the panel member 30 is viewed perpendicular to either of its major sides, the surfaces 32 and 34 do not overlap each other.

Figure 3:
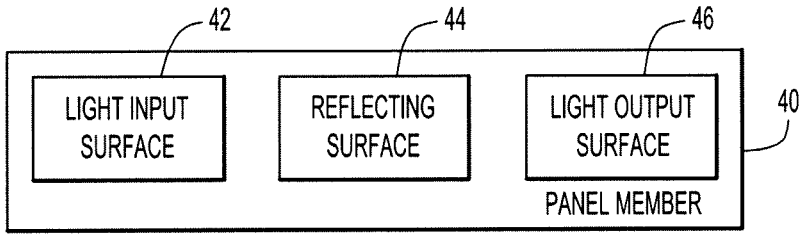
FIG. 3 illustrates a schematic block diagram of another embodiment of a panel member according to the present invention.

Referring to FIG. 3, another embodiment of a panel member according to the present invention is illustrated. In this embodiment, the panel member 40 has a light input surface 42 and a light output surface 46. Similar to panel member 30, in one embodiment, the light input surface 42 and the light output surface 46 are located on opposite sides of the panel member 30 and are offset from each other.

In addition, the panel member 40 includes a reflecting surface 44. The reflecting surface 44 is a surface of the panel member 40 that is configured to reflect light within the panel member 40 from a light source that is incident upon the reflecting surface 44. In one embodiment, the reflecting surface 44 is a continuously curved surface and is an outer surface of the panel member 40. In another embodiment, the reflecting surface 44 includes one or more faceted surfaces that are oriented at angles relative to the light from the light source. The reflecting surface 44 may be oriented so that the light incident thereon is directed along the longitudinal axis of the panel member 40.

In one embodiment, the housings 10 and 20 have different shapes or configurations, and in one implementation, the housings 10 and 20 collectively form a larger object, such as a toy. In one example, housing 10 is the body of a toy figure and housing 20 is an accessory that is coupled to the toy figure. In another example, housing 10 is an accessory for a toy figure and housing 20 is a portion of the accessory. In other embodiments, the housings 10 and 20 can have relatively similar shapes or configurations.

Figure 4:
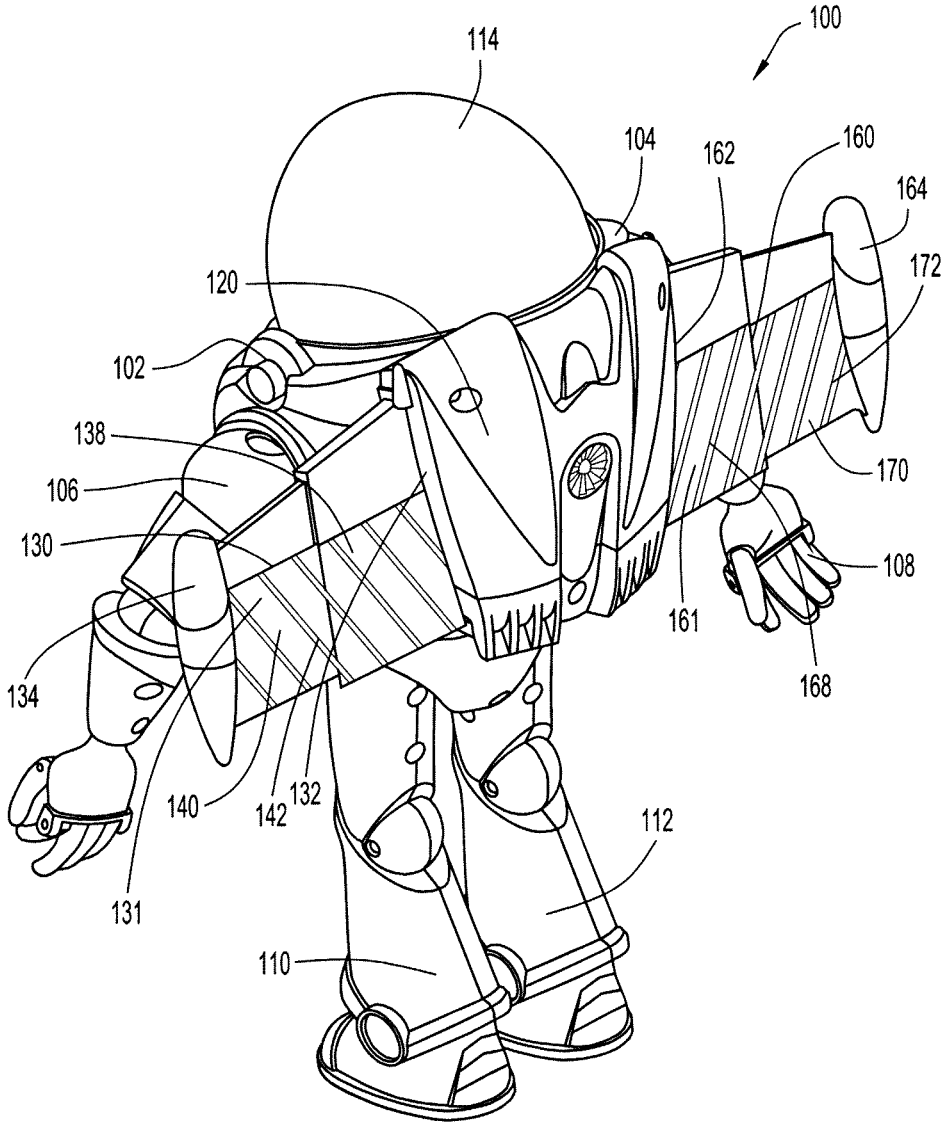
FIG. 4 illustrates a rear perspective view of an embodiment of a toy figure according to the present invention.

Referring to FIG. 4, an embodiment of a toy figure according to the present invention is illustrated. In this embodiment, the toy figure 100 includes a body 102 with a back or rear surface 104 and a pair of arms 106 and 108 and a pair of legs 110 and 112. The body 102 includes a head portion which in FIG. 4 is covered by a helmet 114. The toy figure 100 illustrated in FIG. 4 resembles a BUZZ LIGHTYEAR toy figure. In other embodiments, the toy figure 100 can resemble a different figure or character.

The toy figure 100 includes an accessory 120 that is coupled to the body 102. The accessory 120 is removably mounted to the rear surface 104 of the body 102 via connectors such as screws or via a snap-fit arrangement. The accessory 120 resembles a flight pack that has appendages such as wings or wing portions 130 and 160 extending therefrom. In an alternative embodiment, the accessory 120 is fixedly mounted to the rear surface 104 of the body 102 and cannot be removed.

In the illustrated embodiment, the appendages 130 and 160 are illuminated by light sources. Appendage or wing 130 includes a panel member or portion 131 that is transparent or translucent and that is illuminated by a light source. Appendage 130 has a proximal end 132 coupled to the accessory 120 and an opposite distal end 134. The appendage 130 has a front surface or side 136 (see FIG. 6) and a rear surface or side 138. Sides 136 and 138 are referred to alternatively as major surfaces or sides of either the appendage 130 or panel member 131. At least part of the rear surface 138 forms a light output surface or light emitting portion 140 from which light in the panel member 131 is emitted. In this embodiment, the light output surface 140 includes several deformities 142 formed therein. As shown in FIG. 4, the deformities 142 are spaced apart grooves that are etched or molded into the panel member 131. As described in detail below, light from a light source, such as light source 14 (see FIG. 1), enters the panel member 131 of appendage 130 at a light input surface 154 (see FIG. 6) that is proximate to proximal end 132 and exits through the light output surface 140. As panel member 131 is transparent or translucent, the light being emitting from the panel member 131 via the deformities 142 is visible from the front side 136 of the panel member 131 as well.

Still referring to FIG. 4, appendage 160 also includes a panel member or portion 161 that is transparent or translucent and that is illuminated by a different light source. Appendage 160 has a proximal end 162 coupled to the accessory 120 and an opposite distal end 164. The appendage 160 has a front surface or side and a rear surface or side 168. At least part of the rear surface 168 forms a light output surface 170 from which light in the panel member 161 is emitted. In this embodiment, the light output surface 170 includes several deformities 172 formed therein. In the embodiment depicted in FIG. 4, the deformities 172 are spaced apart grooves that are etched or molded into the panel member 161.

Figure 5:
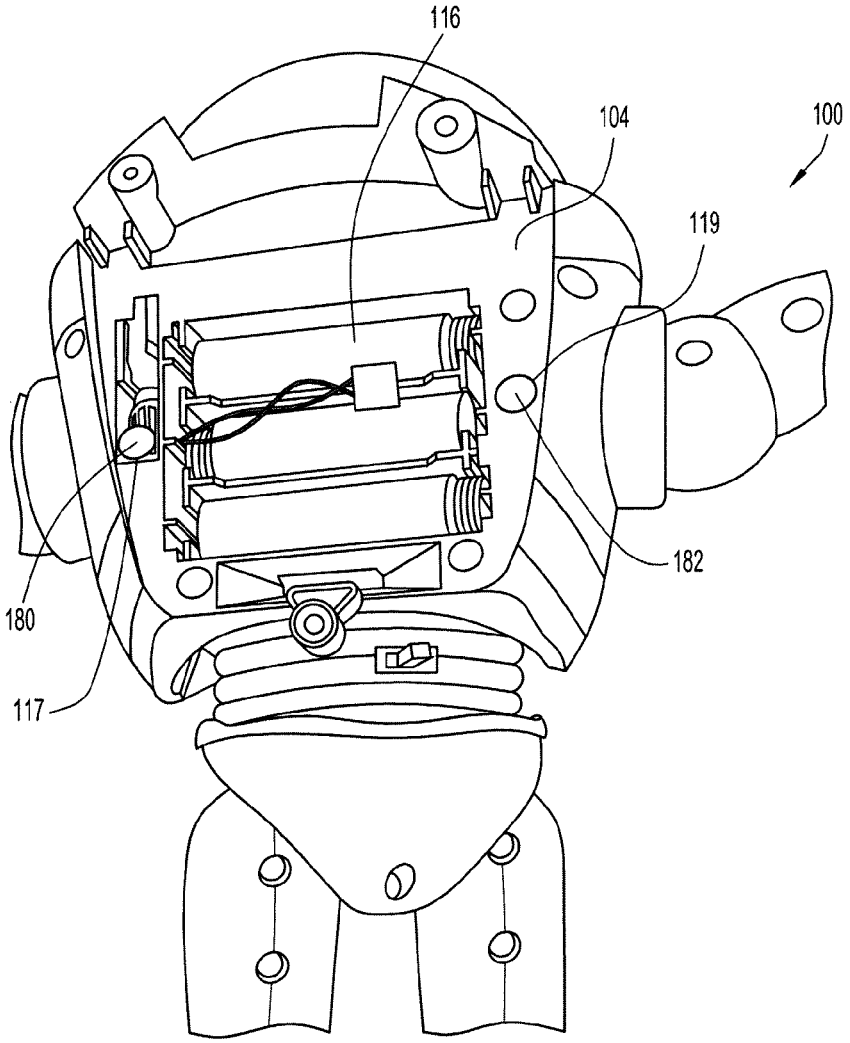
FIG. 5 illustrates a rear view of a portion of the toy figure illustrated in FIG. 4.

Referring to FIG. 5, a rear view of the toy figure 100 is illustrated. In this embodiment, the accessory 120 is removed from the toy figure 100, thereby exposing the rear side 104 of the toy figure 100. The toy figure body 102 includes a battery compartment 116 that is configured to receive one or more batteries to provide power to the electronic system. The electronic system includes LEDs 180 and 182 that are mounted in openings 117 and 119, respectively, formed in the body of the toy figure 100. Each of the LEDs 180 and 182 is positioned so that it directs light into one of the panel members. The LEDs 180 and 182 in the toy figure body 102 are thus, in the same structure as the power source and the rest of the electronic system 12 (see FIG. 1) of the toy figure 100. This location of the LEDs 180 and 182 eliminates the need for any wiring or electrical connections external to the toy figure body 102.

Figure 6:
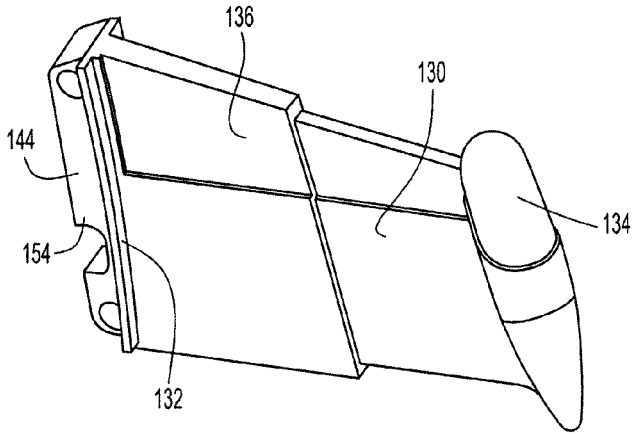
FIG. 6 illustrates a front perspective view of a portion of the toy figure illustrated in FIG. 4.
Figure 7:
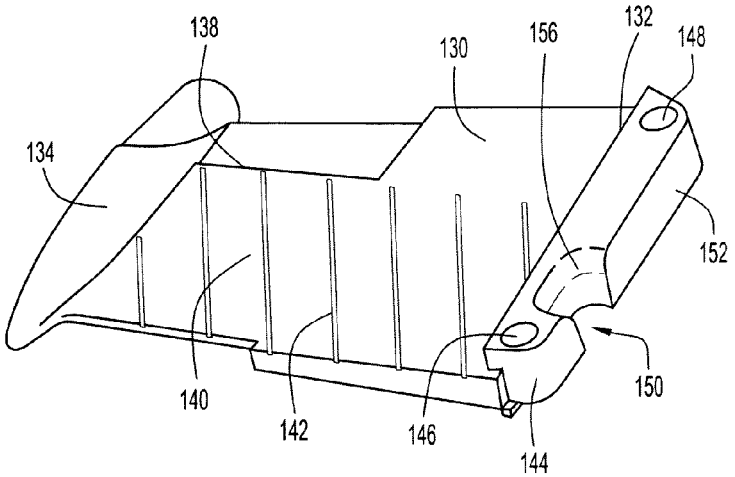
FIG. 7 illustrates a rear perspective view of the wing illustrated in FIG. 6.

Referring to FIGS. 6 and 7, front and rear perspective views of an appendage 130 of toy figure 100 are illustrated. Appendage 160 has a minor-image configuration corresponding to that of appendage 130, and thus, only appendage 130 is described in detail. In FIG. 6, the front surface or side 136 of appendage 130, which extends between opposite ends 132 and 134, is illustrated. The rear side 138 of appendage 130 with light output surface 140 and deformities 142 is illustrated in FIG. 7.

The appendage 130 includes a mounting portion 144 that is coupled to the toy figure body 102 and/or to the accessory 120. Referring to FIG. 7, the mounting portion 144 includes holes 146 and 148 formed therein that receive posts on the toy figure body or connectors such as screws to mount the appendage 130 to the toy figure body. A notch 150 is provided in the end of the appendage 130. The notch 150 receives an alignment shaft or member of the accessory 120 or body 102 when the accessory 120 and appendage 130 are coupled to the toy figure body 102.

The appendage 130 has an end wall 152 at the proximal end 132. Located around the notch 150 is a reflecting surface 156. As shown, the reflecting surface 156 has a curved configuration in this embodiment. Referring back to FIG. 6, a light input surface 154 is located on the front side 136 of the panel member 131. When the panel member 131 is located proximate to the toy figure body 102, the light input surface 154 is located proximate to LED 180. Light from LED 180 enters the panel member 131 through light input surface 154, engages the reflecting surface 156 which is on the opposite side 138 of the panel member 131 from surface 154, and travels within the panel member 131 generally toward end 134. In this embodiment, the reflecting surface 156 is a ¼ circle curved shape that directs the light to travel through the panel member 131.

Figure 8:
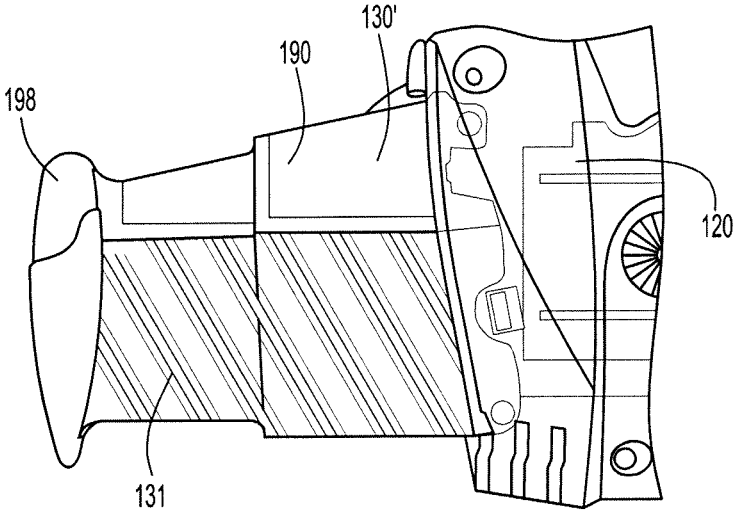
FIG. 8 illustrates a top view of another embodiment of a portion of a toy figure according to the present invention.
Figure 9:
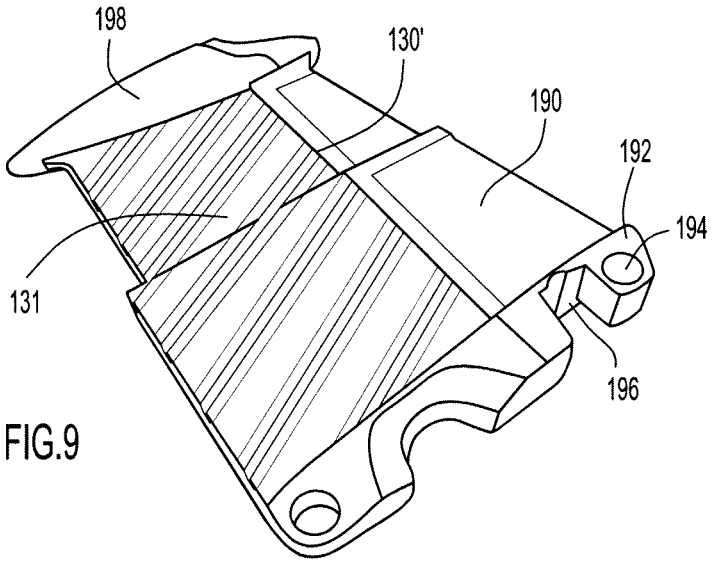
FIG. 9 illustrates a perspective view of the wing illustrated in FIG. 8.

Referring to FIGS. 8 and 9, a top view and a perspective view of an alternative embodiment of an appendage is illustrated. The appendage 130' is generally similar to appendage 130 with an additional support 190 that is located on the panel member 131. The support 190 forms a housing on the panel member 131 and is coupled thereto. The support 190 includes a mounting portion 192 with a mounting hole 194 and an alignment notch 196 that are used to mount the appendage 130 to the toy figure body 102. The support 190 is formed of a plastic material and is opaque. In one implementation, the support 190 can be snapped or slid onto the panel member 131. The support 190 has a distal end 198 that is located at the end opposite to the mounting end of the appendage 130'.

Figure 10:
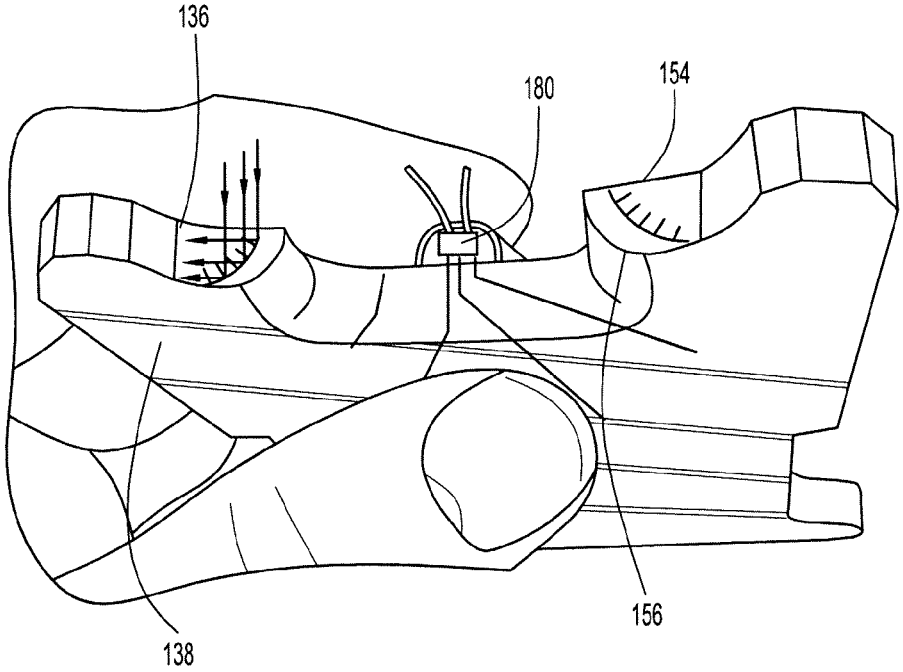
FIG. 10 illustrates an end perspective view of another embodiment of a panel member according to the present invention.
Figure 11:
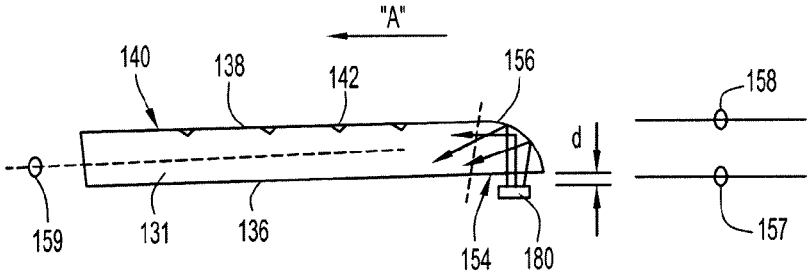
FIG. 11 illustrates a side view of the panel member illustrated in FIG. 10.

Referring to FIGS. 10-11, an end perspective view and a side view of panel member 131 are illustrated. As discussed above, panel member 131 has opposite surfaces or sides 136 and 138. The surfaces 136 and 138 extend along planes 157 and 158, respectively, which are parallel or substantially parallel to each other (see FIG. 11). The reflective or reflecting surface 156 is illustrated in FIG. 10 and is generally located between the planes 157 and 158. In this embodiment, the reflective surface 156 is formed by a continuously curved surface. As mentioned above, in an alternative embodiment, the reflective surface 156 is formed by several facets or faceted surfaces that are slightly angled relative to each other.

Referring specifically to FIG. 11, the light output surface 140 is located on surface 136 and includes deformities 142 as shown. The light input surface 154 is located on surface 138 and in this embodiment is located across the thickness of the panel member 131 from the reflective surface 156. In one implementation, the light input surface 154 is aligned with and coextensive with the reflective surface 156, which is offset from the light output surface 140. In this implementation, the surface area of light output surface 140 is greater than the surface area of the light input surface 154.

Referring to both FIGS. 10 and 11, LED 180 is positioned proximate to light input surface 154 and light emitted from the LED 180 is incident upon the light input surface 154. In one embodiment, the LED 180 is spaced from the light input surface 154 by a distance "d" (see FIG. 11), which is approximately one millimeter. The light that enters the panel member 131 and engages the reflective surface 156 is redirected so that the light travels within the panel member 131 along the generally direction of the longitudinal axis 159, which is 90 degrees or substantially 90 degrees or perpendicular to the LED 180. The light in the panel member 131 is continuously reflected between front surface 136 and rear surface 138 until it engages one of the deformities 142 which cause light to exit the panel member 131.

Figure 12:
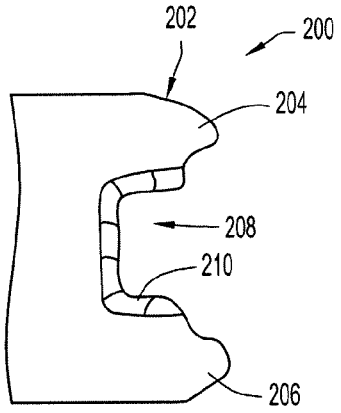
FIG. 12 illustrates a top view of a portion of an alternative embodiment of a panel member according to the present invention.

Referring to FIG. 12, an alternative embodiment of a panel member according to the present invention is illustrated. Only a portion of panel member 200 is illustrated for ease of reference. The panel member 200 includes an end 202 that has projections 204 and 206 that define a notch 208 therebetween. The projections 204 and 206 as well as the notch 208 are used in the aligning and mounting of the panel member 200 onto the toy figure body 102. The panel member 200 includes a reflecting surface 210 as illustrated in FIG. 12.

Figure 13:
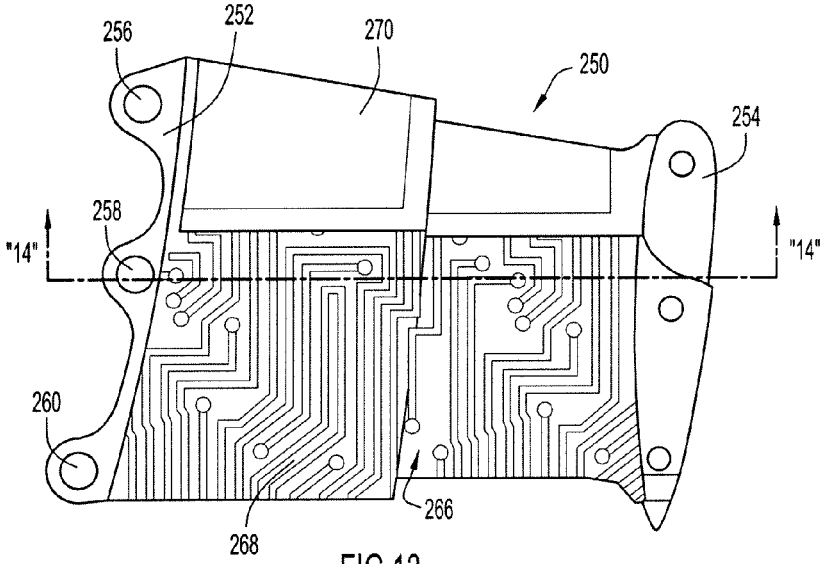
FIG. 13 illustrates a top view of an alternative embodiment of a panel member according to the present invention.
Figure 14:
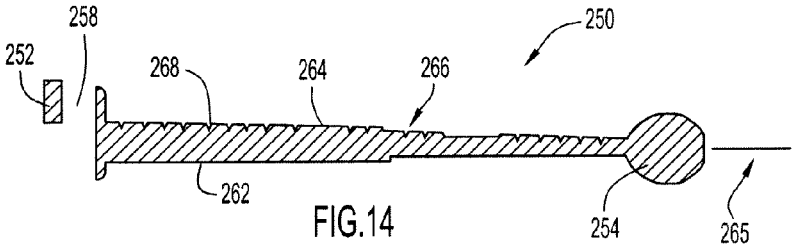
FIG. 14 illustrates a cross-sectional side view of the panel member illustrated in FIG. 13 (taken along line 14-14 of FIG. 13).

Referring to FIGS. 13 and 14, an alternative embodiment of a panel member according to the present invention is illustrated. In this embodiment, the panel member 250 has opposite ends 252 and 254. End 252 is a mounting end that is configured to be mounted or coupled to the toy figure body 102. The mounting end 252 includes several holes 256, 258, and 260 that each receives a post or connector when the components are coupled together. The panel member 250 also includes a support or support portion 270 coupled thereto.

Referring to FIG. 14, the panel member 250 has a front surface 262 and an opposite rear surface 264. The rear surface 264 includes an output area or portion 266 that includes deformities 268 formed therein. The pattern of deformities 268 includes non-parallel grooves as illustrated in FIG. 13.

Figure 15:
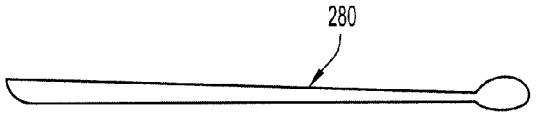
FIG. 15 illustrates a side view of another embodiment of a panel member according to the present invention.

In this embodiment, the thickness of the panel member 250 varies along the longitudinal axis 265 of the panel member 250. As an LED is located proximate to end 252, the thickness of the panel member 250 decreases from end 252 (near the light source) toward end 254 along axis 265. In one embodiment, the thickness decreases in a stepped function or manner as shown in FIG. 13. In another embodiment, the thickness decreases in a gradual continuous manner (see panel member 280 in FIG. 15). The decrease in thickness provides a better edge lit wing effect and improves the uniformity of the lighting along the wing.

In other embodiments, the depth of the deformities can vary along the length of the panel member. For example, the deformities may be formed deeper into the panel member the farther away from the light input end of the panel member. Similarly, if the deformities extend outwardly from the panel member, the height of the deformities can vary along the length of the panel member. The deformities may extend higher from the panel member the farther away from the light input end of the panel member they are disposed. The increased depth or height of the deformities along the length of the panel member results in an improved uniform lighting of the wing along its length.

It is to be understood that terms such as "left," "right," "top," "bottom," "front," "end," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Although the disclosed inventions are illustrated and described herein as embodied in one or more specific examples, it is nevertheless not intended to be limited to the details shown, since various modifications and structural changes may be made therein without departing from the scope of the inventions. In addition, various features from one of the embodiments may be incorporated into another of the embodiments. Accordingly, it is appropriate that the invention be construed broadly and in a manner consistent with the scope of the disclosure.

What is claimed:

1. A toy, comprising:

a first housing having an electronic system including a light source; and a second housing removably coupled to the first housing, the second housing including a panel member spaced apart from the light source, the panel member having a light input surface and a light output surface, the light input surface being spaced apart from, laterally offset from, and substantially parallel to the light output surface, wherein the light input surface receives light from the light source, and the light is subsequently emitted from the light output surface.

2. The toy of claim 1, wherein the panel member is translucent or transparent, and the light output surface is located on the panel member.

3. The toy of claim 1, wherein the light input surface is located on a first side of the panel member and the light output surface is located on a second side of the panel member, the second side being disposed opposite of the first side.

4. The toy of claim 3, wherein the light output surface is a first light output surface and the panel member further comprises:

a second light output surface, wherein the second light output surface is defined by a deformity formed in the first light output surface.

5. The toy of claim 1, wherein the panel member further comprises:

a reflecting surface disposed on an outer surface of the panel member configured to redirect light received at the light input surface towards the light output surface.

6. The toy of claim 5, wherein the reflecting surface is a continuously curved surface.

7. The toy of claim 5, wherein the reflecting surface includes one or more faceted surfaces oriented at angles relative to the light from the light source.

8. A toy, comprising:

a first housing having an electronic system including a light source; and a second housing removably coupled to the first housing, the second housing including a panel member spaced apart from the light source, the panel member having:

a light input surface configured to receive light from the light source;

a light output surface configured to emit the light received from the light source via the light input surface, the light output surface being spaced apart from, laterally offset from, and substantially parallel to the light input surface; and a reflecting surface disposed on an outer surface of the panel member, the reflecting surface being oriented to direct the light received by the light input surface to travel through the panel member to the light output surface.

9. The toy of claim 8, wherein the reflecting surface is a first reflecting surface and the panel member further comprises:

a second reflecting surface, the first and second reflecting surfaces being configured to continuously reflect light received at the input surface towards the light output surface where it may be emitted.

10. The toy of claim 8, wherein the light output surface further comprises:

at least one deformity which causes the light to exit the panel member.

11. The toy of claim 10, wherein the at least one deformity is an etching in the light output surface.

12. The toy of claim 10, wherein the at least one deformity is a ridge extending outwardly from the light output surface.

13. The toy of claim 8, wherein the first housing is a body of a toy figurine and the second housing is a pair of wings.

14. The toy of claim 8, wherein the panel member further comprises:

a body having:

a first major surface defining the light output surface, the first major surface extending along a first plane;

a second major surface opposite to the first major surface, the second major surface being substantially parallel to the first major surface, the second major surface extending along a second plane, the second major surface being larger than the first major surface, the difference between the second major surface and the first major surface defining the light input surface, wherein the reflective surface is located proximate to the light input surface between the first plane and the second plane.

* * * * *